United States Patent [19]

Vanbuskirk

[11] 4,013,245

[45] Mar. 22, 1977

[54] HOMING PROJECTILE

[75] Inventor: Lyman F. Vanbuskirk, Ridgecrest, Calif.

[73] Assignee: The United States of America as represented by the Secretary of the Navy, Washington, D.C.

[22] Filed: Dec. 5, 1975

[21] Appl. No.: 638,138

[52] U.S. Cl. ..... 244/3.16; 244/3.21

[51] Int. Cl.[2] ..... F41G 7/14; F41G 7/00; F41G 7/18; F42B 13/32

[58] Field of Search ..... 244/3.21, 3.16

[56] References Cited

UNITED STATES PATENTS

| | | | |
|---|---|---|---|
| 3,034,405 | 5/1962 | Biberman et al. | 244/3.16 |
| 3,167,275 | 1/1965 | Hermann et al. | 244/3.21 |
| 3,504,869 | 4/1970 | Evans et al. | 244/3.16 |
| 3,642,233 | 2/1972 | Bezerie | 244/3.16 |

*Primary Examiner*—Verlin R. Pendegrass
*Assistant Examiner*—Thomas H. Webb
*Attorney, Agent, or Firm*—R. S. Sciascia; Roy Miller; W. Thom Skeer

[57] ABSTRACT

An optical guidance system for a spin-stabilized autorotative projectile having a target radiation detector, a detector cooling means, a fixed-coil electromagnet and a tuned-frequency steering vane. During projectile flight the detector temperature is reduced for increasing the sensitivity of the detector to radiation. When target radiation is detected, a signal is generated that is representative of target deviation from the flight path of the projectile. This signal sets up a periodic oscillation in an electromagnet for generating an electromagnetic force which, periodically and in phase with the oscillation, projects a steering vane into the air stream, creating a lift on the projectile to steer it to a target.

6 Claims, 4 Drawing Figures

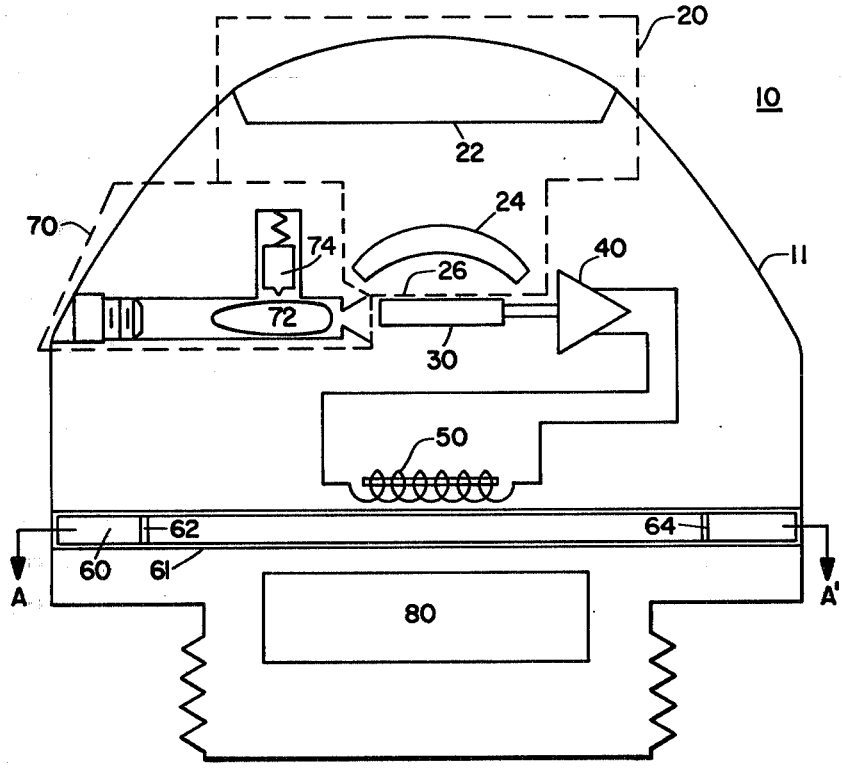
FIG. 1
FIG. 2
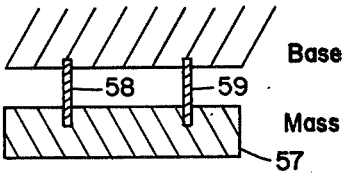
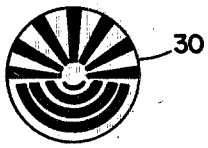
FIG. 4
FIG. 3
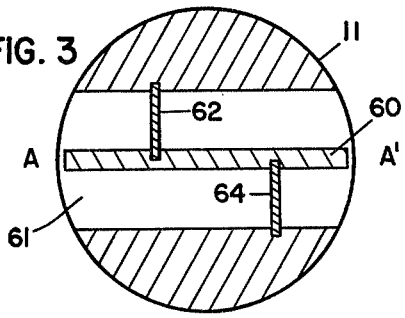

HOMING PROJECTILE

BACKGROUND OF THE INVENTION

This invention relates to optical guidance systems for spin-stabilized autorotative projectiles having a large initial acceleration and velocity, and more particularly to a mechanism for changing the flight path of a projectile to reduce dispersion (miss distance).

In the prior art, mechanisms for changing the flight path of a projectile may generally be separated into two groups.

The first group of mechanisms is utilized in class of projectiles generally referred to as missiles. These mechanisms generally take the form of fins, rudders or vanes which are located on the outside of the missile casing and, while suitable for low initial acceleration, such mechanisms will not withstand a large initial acceleration.

The second group of mechanisms is utilized in ballistic projectiles that have a large initial acceleration followed by free flight. This group of mechanisms takes the form of explosive charges ejected from the side of the projectile during flight. While this method will deflect the projectile, the charges are limited in number and produce a non-linear control function. The present guidance mechanism overcomes the limitations discussed above and has the additional advantage of being a single mechanism which may be utilized by missiles and ballistic projectiles.

SUMMARY OF THE INVENTION

The present invention is a mechanism for guiding a spin-stabilized autorotative projectile toward a radiating target.

Target radiation enters a lens system mounted in the front of the projectile and is focused on the lens system focal plane. A detector, formed in a reticle pattern, is fixedly placed in the lens system focal plane. The detector converts the radiation at the focal plane into a signal representative of the deviation of the flight path from the target. Due to detector construction and projectile rotation, the deviation signal is periodic, having a period in phase and synchronous with the rotational period of the projectile.

The periodic deviation signal is coupled through an amplifier into a fixed-coil electromagnet. The electromagnet generates an oscillating magnetic field having a period representative of the projectile rotation period and an amplitude representative of the target deviation, i.e. the angular separation from the projectile axis.

A tuned-frequency vane is mounted on a modified Cardan hinge. The hinge has a resonant frequency equal to the rotation period of the projectile. The vane is oriented perpendicular to the longitudinal axis of the projectile and so positioned as to be inductively coupled to the fixed-coil electromagnet.

The magnetic field causes an oscillation in the vane that is a function of target deviation and projectile rotation. As the vane oscillates, it is alternately projected into the airstream in a correct orientation to cause lift in the direction of the target. This action allows the projectile to present an aerodynamic lift body into the relative airstream for effectively changing its velocity vector toward the target thereby redirecting the projectile from its initial trajectory for reducing miss distance.

In other applications, other devices, such as solenoids, may be used to project the tuned-frequency vane.

BRIEF DESCRIPTION OF THE DRAWING

FIG. 1 is a diagrammatic representation of an embodiment of the present invention;

FIG. 2 is a diagrammatic representation of a classical Cardan hinge;

FIG. 3 is a cross sectional view along A—A′ of the diagrammatic representation of the embodiment in FIG. 1;

FIG. 4 is a diagrammatic representation of the reticle pattern used in the embodiment of FIG. 1.

DETAILED DESCRIPTION OF AN EMBODIMENT OF THE INVENTION

Referring now to the drawing, FIG. 1 illustrates an optical guidance system 10 positioned in a spin-stabilized autorotative projectile (not shown). Lens system 20 has an objective lens 22 centered in the forward edge of a casing 11 for enclosing optical guidance system 10 within the nose of the projectile. A focussing lens 24 is located to focus an image, from the objective lens 22, onto a focal plane 26.

A radiation detector 30, formed in the reticle pattern shown in FIG. 4, is fixedly located at the focal plane 26. The detector 30 output is connected via amplifier 40 to a fixed-coil electromagnet 50.

A tuned-frequency vane 60 is positioned in a rectangular slot 61 which extends through openings in casing 11. The rectangular slot 61 is immediately adjacent and parallel to the fixed-coil electromagnet 50 and both are oriented perpendicular to the longitudinal axis of the projectile so that tuned-frequency vane 60 is inductively coupled to fixed-coil electromagnet 50.

FIG. 2 shows a classical Cardan hinge that has its frequency of oscillation determined by the dimensions and weight of a mass 57 and the length, location and material used in the springs 58 and 59. This Cardan hinge oscillates in an arcuate path.

The cross sectional view A—A′ of FIG. 3 shows the modified Cardan hinge arrangement by which the tuned-frequency vane 60 is suspended in the rectangular slot 61. Each bar 62, 64, corresponding to springs 58 and 59 respectively of FIG. 2, is constructed from spring material and is attached to the tuned-frequency vane 60. The bars are situated on opposing sides and adjacent to opposing ends of the vane 60 as shown in FIG. 3. This construction causes a path of vane oscillation that is curvilinear and allows construction of the tuned frequency vane 60 and the spring bars 62, 64 so as to give a resonant frequency representative of the rotation period of the particular projectile in which the vane is installed.

Although a modified Cardan hinge is shown in this embodiment, it is within the scope of the invention that for other applications, other devices, such as solenoids, may be used.

Detector cooling system 70 has a coolant enclosed in a frangible container 72 that is proximately located with respect to radiation detector 30. An inertia-operated release mechanism 74 releases the coolant a predetermined time after projectile firing, when the projectile attains a predetermined acceleration.

An electrical power system illustrated as block 80 may be any conventional self-contained electrical power source suitable in size and power requirements for supplying electrical power to the guidance system 10 electrical components.

In operation, the optical guidance system 10 is securely attached to the front end of a projectile designed to be fired from a gun. Upon firing, a flight stabilizing rotation of the projectile occurs due to travel of the projectile through the rifled gun barrel. Firing also impells the missile forward with a high initial acceleration. This acceleration forces inertia-operated release mechanism 74 against frangible container 72, breaking container 72, and releasing the coolant proximate to radiation detector 30 thereby reducing the temperature of detector 30. The reduction in the temperature of detector 30 results in a corresponding increase in the sensitivity of detector 30.

Target radiation impinging on lens system 20 as the projectile travels along its trajectory will be focused on the focal plane 26 at an off-center distance that is representative of the deviation of the longitudinal axis of the projectile from the flight path to the target.

The radiation detector 30, located at the focal plane 26, will detect the radiation and convert the radiation into a signal representative of the distance and direction of projectile flight path deviation from the target. As the projectile rotates, the radiation will generate a locus around the detector 30 center, making the deviation signal periodic.

The deviation signal is coupled through amplifier 40 to the fixedcoil electromagnet 50 thereby causing an oscillating magnetic field to be generated. The magnetic field has a period representative of the projectile rotation period and flight path deviation direction and an amplitude representative of the projectile flight path deviation angle.

The oscillating magnetic field builds up an oscillation in the tuned-frequency vane 60 thereby alternately projecting the vane 60 through the slot 61 openings in casing 11 and into the airstream surrounding the projectile. As the oscillation of the tuned-frequency vane is a function of projectile rotation, the vane 60 will be projected into the airstream in the same relative orientation. The distance the vane 60 is projected into the airstream is determined by the amplitude of the deviation signal.

Projecting the vane 60 into the airstream creates a lift on the projectile in one direction, moving the projectile form its flight path in the direction of the lift. As the oscillation of the vane 60 is also a function of the flight path deviation, the vane 60 will be projected at the rotation position creating the lift in the target direction. This lift directs the projectile toward the target, reducing miss distance.

When no radiation is detected or if the optical guidance system 10 fails, the projectile will follow a normal ballistic pattern.

Although an embodiment has been described, it will be understood that within the perview of this invention various changes may be made in the form, details, proportion and arrangement of parts, the combination thereof and mode of operation, which generally stated, consists in a device capable of carrying out the features set forth, as disclosed and defined in the appended claims.

What is claimed is:

1. A guidance system mounted in a spin-stabilized autorotative projectile for directing said projectile along a flight path towards a target comprising;

target detection means fixedly mounted in said projectile for providing an output signal representative of a deviation of the projectile flight path from the target;

drive means mounted in said guidance system and effectively coupled to said detection means output so as to receive said deviation signal for providing a force in response thereto having a frequency representative of the period of rotation of the projectile and an amplitude representative of the deviation path from the target;

a tuned frequency vane extensibly mounted in a slot extending through said projectile, said slot and vane being positioned transverse to said flight path, and coupled to said receiving and providing means and responsive thereto whereby the vane is periodically extended out of said projectile from an enclosed position within said slot in response to said force thereby creating a lift on said projectile which alters the flight path towards the target.

2. The guidance system of claim 1 wherein said target detection means includes;

a radiation detector, and detector cooling means proximately situated to said detector whereby the temperature of the detector is reduced thereby increasing the sensitivity of said detector.

3. The guidance system of claim 2 wherein said detector cooling means comprises:

a frangible container enclosing a coolant, and an inertia-operated coolant release mechanism whereby the coolant is released when the projectile reaches a predetermined acceleration.

4. The guidance system of claim 1 wherein said receiving and providing means comprises an electromagnet coupled to said detection means output for receiving said deviation signal and providing an electromagnetic field in response thereto.

5. The guidance system of claim 4 wherein said tuned-frequency vane is extensibly mounted on a modified Cardan hinge and inductively coupled to said electromagnetic field.

6. The guidance system of claim 5 wherein said inductive coupling comprises a solenoid coupled to said detection means output.

* * * * *